United States Patent [19]

Ogoda

[11] Patent Number: 4,986,527

[45] Date of Patent: Jan. 22, 1991

[54] METHOD AND MECHANISM FOR FEEDING AND POSITIONING A SHEET

[75] Inventor: Makoto Ogoda, Kanagawa, Japan

[73] Assignee: Fuji Photo Film Co., Ltd., Kanagawa, Japan

[21] Appl. No.: 324,861

[22] Filed: Mar. 17, 1989

[30] Foreign Application Priority Data

Mar. 18, 1988 [JP] Japan ..... 63-65056

[51] Int. Cl.[5] ..... B65H 9/10

[52] U.S. Cl. ..... 271/250; 271/274

[58] Field of Search ..... 271/272, 273, 274, 246, 271/247, 250

[56] References Cited

U.S. PATENT DOCUMENTS 4,245,836 1/1981 Joosten ..... 271/236 X
4,470,349 9/1984 Godlewski ..... 271/246 X
4,533,134 8/1985 Galster ..... 271/250 X
4,848,765 7/1989 Torii ..... 271/274

*Primary Examiner*—Richard A. Schacher
*Attorney, Agent, or Firm*—Sughrue, Mion, Zinn, Macpeak & Seas

[57] ABSTRACT

A sheet such as a stimulable phosphor sheet, a photographic film, or the like is fed toward an image reading mechanism for reading an image from the sheet or an image reproducing mechanism for reproducing an image on the sheet. The sheet is gripped and fed by at least one pair of rollers, which are then displaced away from each other to release the sheet. The sheet is displaced in a direction perpendicular to the direction in which it is fed by the rollers, until the sheet is positioned in a predetermined position. Thereafter, the positioned sheet is gripped again by the rollers and fed thereby into the image reading mechanism or the image reproducing mechanism.

9 Claims, 5 Drawing Sheets

METHOD AND MECHANISM FOR FEEDING AND POSITIONING A SHEET

BACKGROUND OF THE INVENTION

The present invention relates to a method of and a mechanism for feeding and positioning a sheet, and more particularly to a method of and a mechanism for feeding and positioning a sheet such as a stimulable phosphor sheet, a photographic photosensitive sheet, or the like in order to read or reproduce a recorded image from or on the sheet, by gripping the sheet with a pair of rollers, then spacing the rollers from each other to free the sheet therebetween, positioning the sheet in a prescribed position with a positioning means, and then gripping the positioned sheet again with the rollers to feed the sheet from the prescribed position for accurately reading or reproducing the image from the sheet.

There has recently been known a radiation image information recording and reproducing system for producing the radiation-transmitted image of an object using a stimulable phosphor material capable of emitting light upon exposure to stimulating rays. When a certain phosphor is exposed to a radiation such as X-rays, $\alpha$-rays, $\beta$-rays, $\gamma$-rays, cathode rays, or ultraviolet rays, the phosphor stores a part of the energy of the radiation. When the phosphor exposed to the radiation is subsequently exposed to stimulating rays such as visible light, the phosphor emits light in proportion to the stored energy of the radiation. The phosphor exhibiting such a property is referred to as a "stimulable phosphor".

In the radiation image recording and reproducing system employing such a stimulable phosphor, the radiation image information of an object such as a human body is stored in a sheet having a layer of stimulable phosphor, and then the stimulable phosphor sheet is scanned with stimulating rays such as a laser beam to cause the stimulable phosphor sheet to emit light representative of the radiation image. The emitted light is then photoelectrically detected to produce an image information signal that is electrically processed for generating image information which is recorded as a visible image on a recording medium such as a photosensitive material or displayed as a visible image on a CRT or the like.

The radiation image recorded on the stimulable phosphor sheet is read in the radiation image recording and reproducing system as follows:

The radiation image recording and reproducing system includes an image reader for two-dimensionally scanning the stimulable phosphor sheet with a light beam such as a laser beam to cause the stimulable phosphor sheet to emit light, and detecting the light in time series with a light detector such as a photomultiplier to obtain image information. The stimulable phosphor sheet is usually two-dimensionally scanned by deflecting the light beam and applying the deflected light beam to the stimulable phosphor sheet in a main scanning direction, and simultaneously feeding the stimulable phosphor sheet mechanically on a conveyor belt o the like in an auxiliary scanning direction substantially normal to the main scanning direction.

When reading a radiation image from the stimulable phosphor sheet, it is not ensured that the stimulable phosphor sheet will be positioned in a predetermined position at all times. That is, while the stimulable phosphor sheet is being fed by the conveyor means from a cassette or a magazine, it may be positionally displaced particularly in the transverse direction. If the stimulable phosphor sheet is transversely displaced in position, the radiation image recorded on the stimulable phosphor sheet may not accurately be read from the sheet. To avoid such a problem, any positional displacement which has taken place in the transverse direction should be corrected to position the stimulable phosphor sheet accurately in a desired position when the stimulable phosphor sheet is subjected to an image reading process.

However, where a plurality of roller pairs are employed as feed means for feeding the stimulable phosphor sheet, since the stimulable phosphor sheet remains gripped by the rollers, it is impossible to eliminate any undesirable transverse positional displacement or error of the stimulable phosphor sheet.

SUMMARY OF THE INVENTION

It is a major object of the present invention to provide a method of and a mechanism for feeding and positioning a sheet such as a stimulable phosphor sheet, a photographic photosensitive sheet, or the like in order to read or reproduce a recorded image from or on the sheet, by gripping the sheet with a pair of rollers, then displacing the rollers from each other to release the sheet therebetween, pressing one side of the sheet with a positioning means to position the sheet in a prescribed position with reference to the other side of the sheet, and thereafter gripping the sheet again with the rollers to feed the sheet for an image reading or reproducing process, so that the sheet can be stably positioned in an image reading or reproducing position to accurately effect the image reading or reproducing process.

Another object of the present invention is to provide a method of feeding and positioning a sheet for reading an image from the sheet or reproducing an image from the sheet, said method comprising the steps of: gripping the sheet with at least one pair of rollers to feed the sheet; displacing said rollers away from each other to release the sheet between the rollers; displacing the sheet in a predetermined direction to position the sheet in a prescribed position; and gripping the positioned sheet again with said rollers to feed the sheet toward an image reading or reproducing mechanism.

Still another object of the present invention is to provide a method wherein said step of displacing the sheet comprises the step of displacing the sheet in a direction substantially perpendicular to the direction in which the sheet is fed by said rollers.

Yet another object of the present invention is to provide a mechanism for feeding and positioning a sheet, comprising: at least one pair of rollers for gripping the sheet to feed the sheet; displacing means for displacing said rollers away from each other to release the sheet between the rollers; and positioning means for displacing the sheet in a predetermined direction to position the sheet in a prescribed position.

Yet still another object of the present invention is to provide a mechanism further including stopper means for holding the sheet in place when said rollers are displaced away from each other by said displacing means.

A further object of the present invention is to provide a mechanism wherein said rollers are normally urged to be held against each other by a resilient member, said displacing means comprising a cam member disposed between said rollers and operatively engaging said rollers, and an actuator for moving said cam member selectively in a first direction to move said rollers away from each other and in a second direction opposite to said first direction for moving said rollers toward each other.

A yet further object of the present invention is to provide a mechanism wherein said actuator comprises a rotative drive source, a cam rotatable by said rotative drive source, a swing member engaging said cam and angularly movable thereby, a filamentary member having one end coupled to said swing member and the other end connected to one end of said cam member, and a resilient member engaging the opposite end of said cam member for normally urging the cam member in said second direction.

A still further object of the present invention is to provide a mechanism comprising at least two pairs of rollers for gripping the sheet to feed the sheet, said displacing means comprising at least two cam members disposed respectively between the rollers in the respective pairs, said filamentary member being connected at the other end thereof to said one end of each of the cam members, whereby said cam members are movable in unison by said filamentary member when said rotative drive source is operated.

A yet still further object of the present invention is to provide a mechanism wherein said stopper means comprises an actuator and a stopper member swingable by said actuator into a path along which said sheet is fed by said rollers, for holding one end of the sheet.

Still another object of the present invention is to provide a mechanism wherein said positioning means comprises a positioning member disposed on one lateral side of a path along which said sheet is fed by said rollers, a displacing member movable back and forth in directions substantially perpendicular to said path and having a presser member for pressing the sheet, and an actuator for moving said displacing member toward said one lateral side to cause said pressing member to push the sheet against said positioning member, thereby positioning the sheet.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
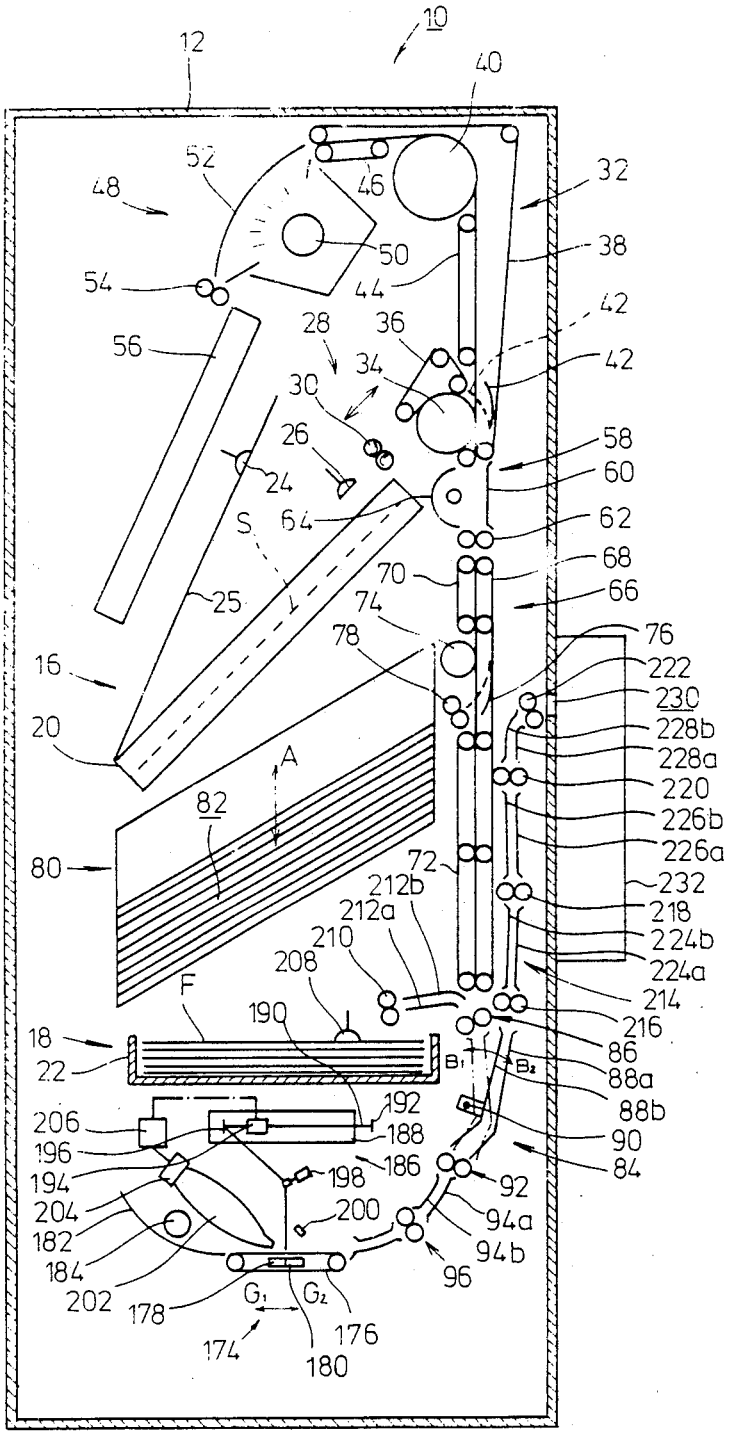
FIG. 1 is a schematic elevational view of an image reading and reproducing system incorporating a sheet feeding and positioning mechanism for carrying out a method of feeding and positioning a sheet according to the present invention.

FIG. 1 shows an image reading and reproducing system, generally designated by the reference numeral 10, which incorporates therein a mechanism for carrying out a method of feeding and positioning a sheet according to the present invention. The image reading and reproducing system 10 including a vertically elongate housing 12 having a first loading unit 16 and a second loading unit 18. A stimulable phosphor sheet S contained in a cassette 20 or a stack of stimulable phosphor sheets S contained in a sheet magazine (not shown) is detachably loaded in the first loading unit 16, whereas a stack of photosensitive films F contained in a film magazine 22 is detachably loaded in the second loading unit 18.

The first loading unit 16 includes a lid opening mechanism having a suction cup 24 connected to a vacuum suction device (not shown) for attracting a lid 25 of the cassette 20 and opening the lid 25. The first loading unit 16 also includes a sheet delivery mechanism including a suction cup 26 positioned on one side of the cassette 20 for removing a stimulable phosphor sheet S from the cassette 20 with its lid 25 open. A stimulable phosphor sheet S which has been removed from the cassette 20 by the suction cup 26 is delivered along a predetermined path, and then supplied to a first feed means 28. The first feed means 28 comprises a pair of rollers 30 which are displaceable toward the suction cup 26 as indicated by one of the arrowheads for gripping the stimulable phosphor sheet S, and also displaceable away from the suction cup 26 as indicated by the other arrowhead for supplying the stimulable phosphor sheet S toward a second feed means 32.

The second feed means 32 comprises a larger-diameter drum 34, a first feed belt 36 held in contact with the drum 34, and a second feed belt 38 held in contact with the drum 34. The first feed belt 36 is trained around three rollers and has a portion held against the drum 34. The second feed belt 38 extends vertically upwardly out of contact with the drum 34, and is bent substantially perpendicularly so as to extend substantially horizontally along an inner surface of an upper panel of the housing 12. The second feed belt 38 remains bent around a larger-diameter roller 40. A first switching guide member 42 is disposed in an area where the second feed belt 38 and the drum 34 are held against each other. A third feed belt 44 is held against a vertical run of the second feed belt 38, and a fourth feed belt 46 is disposed underneath and in contact with a horizontal run of the second feed belt 38.

An eraser unit 48 is positioned in the vicinity of the distal end of the fourth feed belt 46. The eraser unit 48 comprises an erasing light source 50 such as a sodium-vapor lamp, a tungsten lamp, or a xenon lamp, a guide panel 52 for guiding the stimulable phosphor sheet S, and a roller pair 54 disposed beneath the guide panel 52. A tray 56 is positioned below the roller pair 54. When a sheet magazine storing a plurality of stimulable phosphor sheets S is loaded in the first loading unit 16, the tray 56 stores the stimulable phosphor sheets S after recorded images have been read from the stimulable phosphor sheets S fed from the sheet magazine and residual image information has been erased from the stimulable phosphor sheets S by the eraser unit 48.

A third feed means 58 comprises a guide panel 60 disposed below the second feed means 32, and a roller pair 62 is located near the lower end of the guide panel 60. An auxiliary eraser unit 64 is provided near the third feed means 58.

A fourth feed means 66 is disposed downwardly of the roller pair 62. The fourth feed means 66 comprises a relatively long fifth feed belt 68 extending vertically downwardly, a relatively short sixth feed belt 70 held in contact with an upper portion of the fifth feed belt 68, and a seventh feed belt 72 held against a lower portion of the fifth feed belt 68. A roller 74 of a relatively large diameter is held in rolling contact with an intermediate portion of the fifth feed belt 68. A second switching guide member 76 is positioned near the roller 74. The second switching guide member 76 can be angularly displaced into a broken-line position to position its tip end near a roller pair 78. A stimulable phosphor sheet S which has been fed by the fourth feed means 66 can be introduced into a stacker 80 by the roller pair 78.

The stacker 80 is movable vertically in the directions of the arrow A by a motor or the like (not shown). The stacker 80 can store a stimulable phosphor sheet S fed by the roller pair 78 into a desired one of an array of juxtaposed sheet bins 82. The stimulable phosphor sheet S stored in the stacker 80 is then fed to the fourth feed means 66 by the roller pair 78 and the second switching guide member 76.

Figure 2:
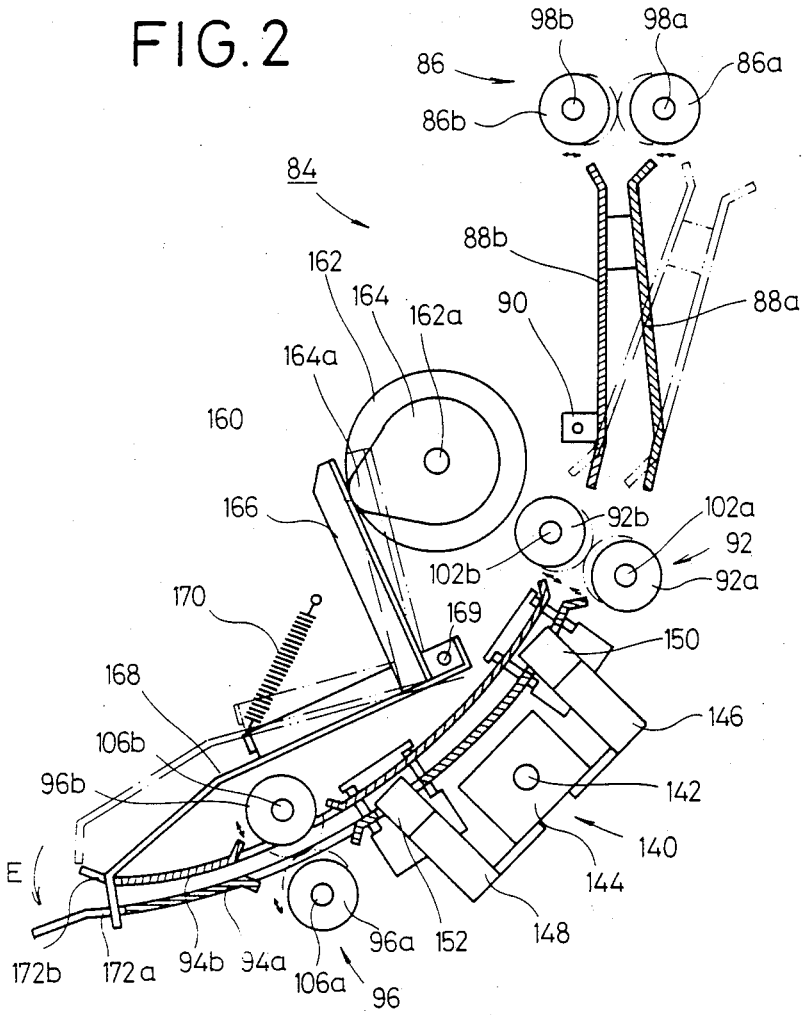
FIG. 2 is a fragmentary elevational view, partly in cross section, of the sheet feeding and positioning mechanism.
Figure 3:
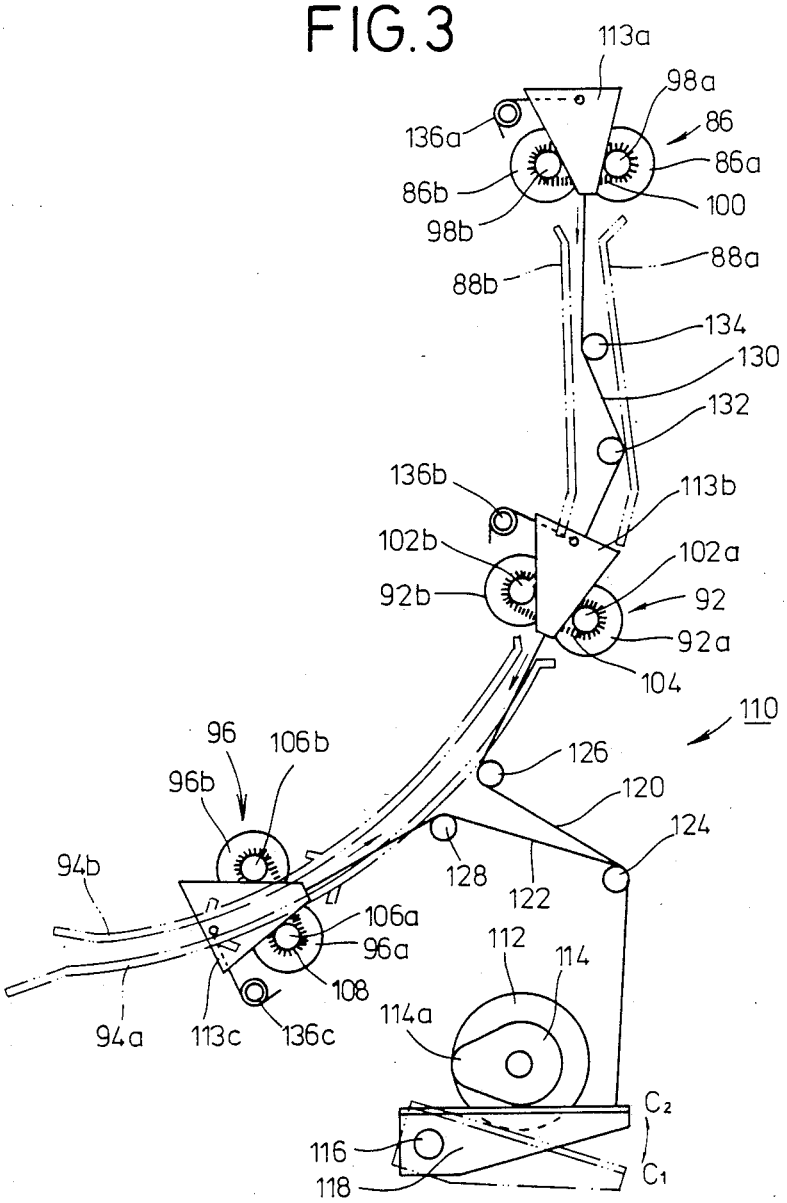
FIG. 3 is a fragmentary elevational view of a displacing means of the sheet feeding and positioning mechanism.

A sheet feeding and positioning mechanism 84 for carrying out the method of the invention is slightly spaced downwardly from the lower ends of the fifth feed belt 68 and the seventh feed belt 72 of the fourth feed means 66. As shown in FIGS. 2 and 3, the sheet feeding and positioning mechanism 84 comprises a roller pair 86 and a pair of movable guide plates **88*a*, 88*b*. The movable guide plates 88*a*, 88*b* are swingable in union about a pivot 90 comprising a pin. The lower ends of the movable guide plates 88*a*, 88*b* are positioned in confronting relation to a roller pair 92 that is positioned above a pair of curved guide plates 94*a*, 94*b***.

A roller pair 96 is situated in intermediate portions of the guide plates **94*a*, 94*b*. The roller pair 86 comprises rollers 86*a*, 86*b*, the roller pair 92 comprises rollers 92*a*, 92*b*, and the roller pair 96 comprises rollers 96*a*, 96*b***. These rollers in each roller pair are movable toward and away from each other as indicated by the two-dot-and-dash lines.

More specifically, as illustrated in FIG. 3, the rollers **86*a*, 86*b* of the roller pair 86 are mounted coaxially on respective shafts 98*a*, 98*b* which are normally urged toward each other by a coil spring 100 engaging one end of the shafts 98*a*, 98*b*. Likewise, the rollers 92*a*, 92*b* are mounted coaxially on respective shafts 102*a*, 102*b* biased by a coil spring 104 engaging the shafts 102*a*, 102*b*, and the rollers 96*a*, 96*b* are mounted coaxially on respective shafts 106*a*, 106*b* biased by a coil spring 104 thereon. Therefore, the rollers 86*a*, 86*b*, the rollers 92*a*, 92*b*, and the rollers 96*a*, 96*b* are normally held in rolling contact with each other in the respective roller pairs 86, 92, 96 by the respective coil springs 100, 104, 108**.

The sheet feeding and positioning mechanism 84 includes a displacing means 110 for displacing the rollers **86*a*, 86*b*, the rollers 92*a*, 92*b*, and the rollers 96*a*, 96*b* away from each other in the respective roller pairs 86, 92, 96. The displacing means 110 comprises a rotative drive source 112, a cam member 113*a* interposed between the shafts 98*a*, 98*b*, a cam member 113*b* interposed between the shafts 102*a*, 102*b*, and a cam member 113*c* interposed between the shafts 106*a*,106*b*. The rotative drive source 112 has a rotatable shaft 112*a* on which a cam 114 is mounted. The cam 114 is held in slidable contact with a swing member 118 that is angularly movable in the directions of the arrows $C_1$ and $C_2$ about a pin 116 engaging one end of the swing member 118**.

When the rotative drive source 112 is operated, the cam 114 is rotated by the shaft **112*a* to bring a cam lobe 114*a* into engagement with the swing member 118**, which then causes its other end to turn in the direction of arrow $C_1$.

Wires 120, 122 are joined to the other end of the swing member 118. The wire 120 is trained around pulleys 124, 126 and connected to one narrower end of the cam member **113*b*, whereas the wire 122 is trained around the pulley 124 and a pulley 128 and connected to one narrower end of the cam member 113*c*. The other wider end of the cam member 113*b* is joined to a wire 130 that is fixed to one narrower end of the cam member 113*a* and has an intermediate wire portion engaging pulleys 132, 134**.

The cam member **113*a* is substantially triangular in shape and has two slanted cam surfaces abutting against the shafts 98*a*, 98*b*, respectively. The cam members 113*b*, 113*c* are similar in shape to the cam member 113*a* and have respective pairs of slanted surfaces abutting against the shafts 102*a*, 102*b* and 106*a*, 106*b*. The wider ends of the cam members 113*a*, 113*b*, 113*c* are engaged by respective torsion springs 136*a*, 136*b*, 136*c* which normally urge the cam members 113*a*, 113*b*, 113*c*** to move in the directions opposite to the directions indicated by the arrows.

Figure 4:
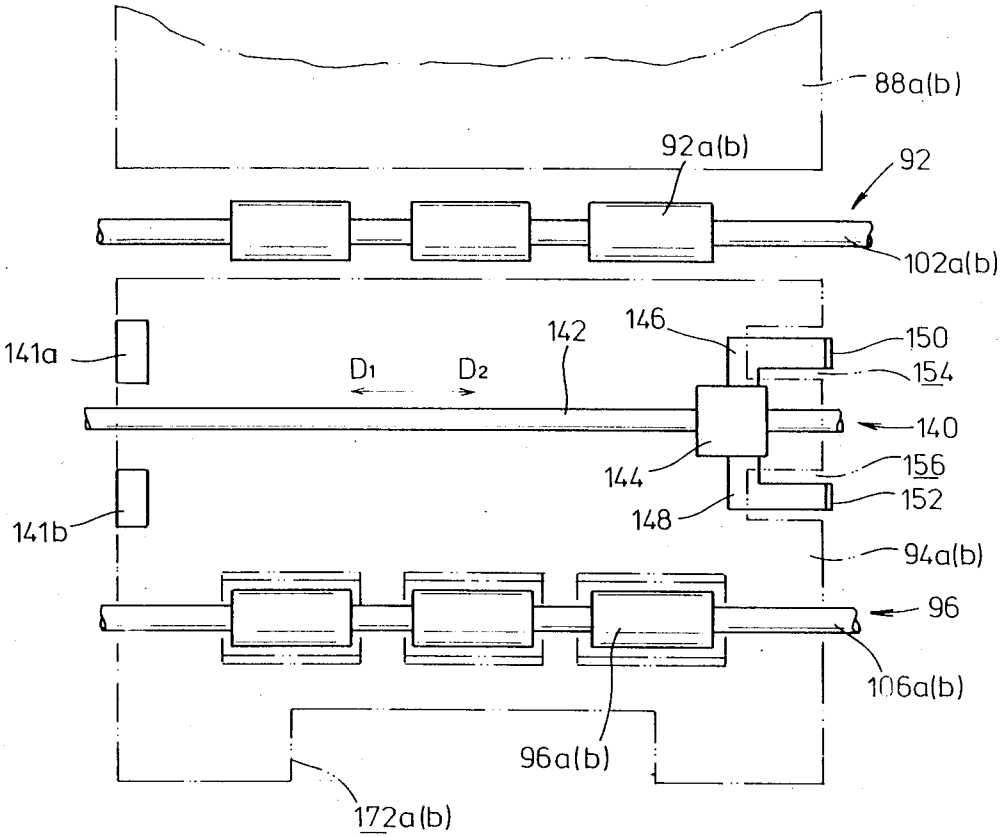
FIG. 4 is a fragmentary view of a positioning means of the sheet feeding and positioning mechanism.
Figure 5:
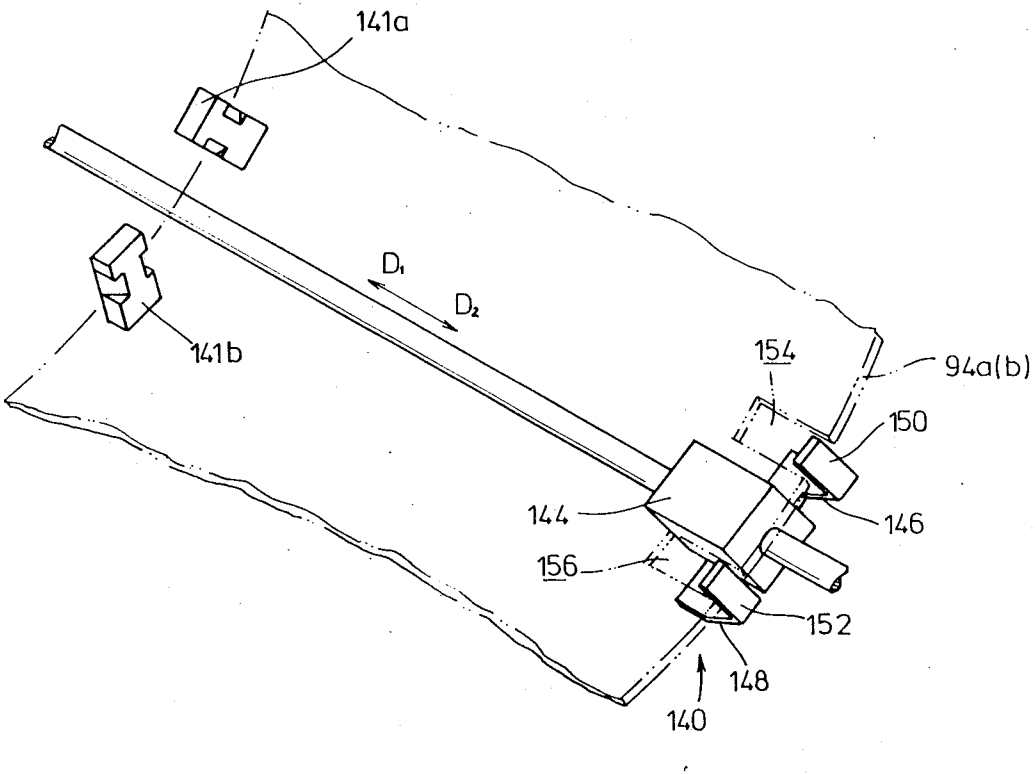
FIG. 5 is a fragmentary perspective view of the positioning means illustrated in FIG. 4.

As shown in FIGS. 2, 4, and 5, a positioning means 140 is located near intermediate portions of the guide plates **94*a*, 94*b* for positioning a stimulable phosphor sheet S and a film F which are fed between the guide plates 94*a*, 94*b*. The positioning means 140 comprises a pair of positioning members 141*a*, 141*b* disposed on one side of the guide plates 94*a*, 94*b*, and a guide rod 142 disposed below the guide plate 94*a* and extending transversely across the guide plate 94*a*. A displacing member 144 is slidably fitted over the guide rod 142. The displacing member 144 can be moved by a linear actuator (not shown) in the directions indicated by the arrows $D_1$, $D_2$. Presser members 146, 148 are attached to the displacing member 144 on the other side of the guide plates 94*a*, 94*b*, and have respective tip ends 150, 152 bent upwardly. Displacement of the displacing member 144 in the direction of the arrow $D_1$ causes the tip ends 150, 152 to enter recesses 154, 156, respectively, defined in the guide plate 94*a***.

A stopper means 160 is disposed near the guide plate **94*b*. The stopper means 160 comprises a rotative drive source 162 having a rotatable shaft 162*a* with a cam 164 mounted thereon. The cam 164 is held against one end of a sliding contact member 166, the other end of which is fixed to one end of a bent stopper member 168 that is swingable about a pin 169. A tension spring 170 engages an intermediate portion of the stopper member 168 for normally urging the stopper member 168 to cause the sliding contact member 166 to slidingly contact the cam 164. When a cam lobe 164*a* of the cam 164 engages the sliding contact member 166, the other end of the stopper member 168 is angularly displaced as indicated by the arrow E against the tension of the tension spring 170. Upon angular displacement in the direction indicated by the arrow E, the other end of the stop member 168 enters recesses 172*a*, 172*b* defined in the guide plates 94*a*, 94*b***, respectively, near their distal ends.

An auxiliary scanning feed means 174 is located in a position which is slightly spaced from the sheet feeding and positioning mechanism 84, as shown in FIG. 1. The auxiliary scanning feed means 174 comprises an auxiliary scanning endless feed belt 176 having a plurality of holes (not shown) defined therein, and first and second suction boxes 178, 180 disposed in the endless feed belt 176 for attracting a stimulable phosphor sheet S and a film F fed by the endless feed belt 176, under a vacuum applied through the holes of the feed belt 176. The first and second suction boxes 178, 180 are connected to a vacuum suction device (not shown). The auxiliary scanning feed belt 176 serves to feed the stimulable phosphor sheet S and the film F supplied from the sheet feeding and positioning mechanism 84 toward a guide plate 182, and to thereafter feed them in the opposite direction for auxiliary scanning. A roller 184 is positioned near the guide plate 182 for preventing the stimulable phosphor sheet S and the film F from rising off the guide plate 182 due to flexing of the stimulable phosphor sheet S and the film F.

An image reading and recording mechanism 186 is positioned above the auxiliary scanning feed means 174 for reading image information recorded on the stimulable phosphor sheet S and exposing the film F to the image information thus read. The image reading and recording mechanism 186 includes a laser beam source 188 and a mirror 192 disposed on the laser beam emitting side of the laser beam source 188 for reflecting a laser beam 190 emitted from the laser beam source 188. The laser beam 190 reflected by the mirror 192 passes through a light modulator 194 toward another mirror 196. The light modulator 194 is energized only when an image is to be recorded on the film F, and not energized when an image is read from the stimulable phosphor sheet S. The image reading and recording mechanism 186 also includes a galvanometer mirror 198 and a light-collecting reflecting mirror 200 for scanning the stimulable phosphor sheet S with the laser beam 190 which has been reflected by the mirror 196.

A light guide 202 which extends along a main scanning line is positioned in the area where the stimulable phosphor sheet S is scanned by the laser beam 190, and a photomultiplier 204 is mounted on an upper end of the light guide 202. The photomultiplier 204 is electrically connected to an image information processing circuit 206. Therefore, an electric signal produced by the photomultiplier 204 is sent to the image information processing circuit 206 for image processing, and a processed image is stored in a memory means or the like. The stimulable phosphor sheet S from which the image has been read by the image reading and recording mechanism 186 is then delivered to the eraser unit 48 through the sheet feeding and positioning mechanism 84, the fourth feed means 66, the third feed means 58, and the second feed means 32.

The second loading unit 18 stores the detachable magazine 22 which contains a stack of films F, as described above. A film delivery mechanism including a suction cup 208 is positioned near a film access opening of the magazine 22. The suction cup 208 serves to deliver one film F at a time from within the magazine 22 and supply the film F to a roller pair 210. A pair of guide plates **212*a*, 212*b* is positioned in confronting relation to and slightly spaced from the roller pair 210. The guide plates 212*a*, 212*b* have ends facing the roller pair 86 of the sheet feeding and positioning mechanism 84. When the roller pair 210 operates, the film F supplied to the roller pair 210 is transferred through the roller pair 86 into a position between the movable guide plates 88*a*, 88*b*. The film F is then fed in the auxiliary scanning direction indicated by the arrow G, in substantially the same manner as the stimulable phosphor sheet S. While the film F is being fed in the auxiliary scanning direction, the laser beam 190 is modulated by the light modulator 194 based on the image information read from the stimulable phosphor sheet S, and the film F is exposed to the modulated laser beam 190. The film F to which the image information has been exposed is then fed toward the roller pair 92, after which the film F is guided by the movable guide plates 88*a*, 88*b* into a film feed means 214 extending parallel to the fourth feed means 66**.

The film feed means 216 includes roller pairs 216, 218, 220, 222 spaced at intervals, a pair of guide plates **224*a*, 224*b* disposed between the roller pairs 216, 218, a pair of guide plates 226*a*, 226*b* disposed between the roller pairs 218, 220, and a pair of curved guide plates 228*a*, 228*b* disposed between the roller pairs 220, 222. The roller pair 222 is positioned near an opening 230 defined in a side panel of the housing 12 of the image reading and reproducing system 10. The film F which is fed by the film feed means 214 is sent through the opening 230 into a receiver magazine 232 detachably mounted on the housing 12**.

The mechanism for carrying out the method of feeding and positioning a sheet according to the present invention, and the image reading and reproducing system incorporating the mechanism are basically constructed as described above. Now, the mechanism and the image reading and reproducing system will operate and offers advantages as follows:

The cassette 20 storing a stimulable phosphor sheet S or the sheet magazine (not shown) storing a stack of stimulable phosphor sheets S is loaded into the first loading unit 16 in the image reading and reproducing system 10. In the illustrated embodiment, the cassette 20 is loaded into the first loading unit 16. The lid 25 of the cassette 20 is opened by the suction cup 24 of the lid opening mechanism under a vacuum applied thereby.

Then, the stimulable phosphor sheet S in the cassette 20 is picked up and removed from the cassette 20 by the suction cup 26, and at the same time the roller pair 30 of the first feed mean 28 is displaced toward the suction cup 26, while the rollers of the roller pair 30 are being rotated in the directions indicated by the arrows. The stimulable phosphor sheet S is gripped by the roller pair 30, which is then displaced toward the first feed belt 36 of the second feed means 32 to supply the stimulable phosphor sheet S to the second feed means 32. In the second feed means 32, the stimulable phosphor sheet S is gripped between the drum 34 and the first feed belt 36, and thereafter gripped between the drum 34 and the second feed belt 38 so as to be fed into the third feed means 58. The stimulable phosphor sheet S is then fed from the roller pair 62 of the third feed means 66 into a position between the fifth feed belt 68 and the sixth feed belt 70 of the fourth feed means 66. At this time, the second switching guide member 76 is angularly displaced toward the broken-line position in FIG. 1, and the stimulable phosphor sheet S is stored into one sheet bin 82 in the stacker 80 by the roller pair 78.

Then, the stacker 80 is elevated or lowered as indicated by the arrow A to select a stimulable phosphor sheet S with other image information recorded thereon, stored in the stacker 80. The selected stimulable phosphor sheet S is delivered through the roller pair 78 into the fourth feed means 66 by which the stimulable phosphor sheet S is then fed into the sheet feeding and positioning mechanism 84. The movable guide plates 88*a*, 88*b* of the sheet feeding and positioning mechanism 84 have been turned about the pivot 90 in the direction indicated by the arrows $B_1$ by means of a drive source (not shown). Thus, the stimulable phosphor sheet S is supplied by the roller pair 86 into a gap defined between the movable guide plates 88*a*, 88*b*. The stimulable phosphor sheet S taken out of the cassette 20 may directly be fed by the fourth feed means 66 into the position between the movable guide plates 88*a*, 88*b*.

The stimulable phosphor sheet S supplied between the movable guide plates 88*a*, 88*b* is gripped and fed by the roller pairs 92, 96. At this time, the stimulable phosphor sheet S which is thus supplied may be positionally displaced in the transverse direction. To avoid such positional displacement, the stimulable phosphor sheet S is positioned in a desired location as follows:

First, the rotative drive source 162 of the stopper means 160 is energized to rotate the shaft 162 to bring the lobe 164*a* of the cam 164 on the shaft 162 into engagement with the sliding contact member 166. The other end of the stopper member 168 is angularly displaced in the direction of the arrow E by the sliding contact member 166 against the tension of the tension spring 170, until the other end of the stopper member 168 enters the recesses 172*a*, 172*b* defined in the distal ends of the guide plates 94*a*, 94*b*.

Then, the rollers 86*a*, 86*b*, the rollers 92*a*, 92*b*, and the rollers 96*a*, 96*b* of the roller pairs 86, 92, 96 are displaced away from each other. More specifically, the rotative drive source 112 of the displacing means 110 is actuated to rotate the shaft 112*a* and the cam 116 mounted thereon to bring the cam lobe 114*a* into engagement with the swing member 118. The engagement of the cam lobe 114*a* with the swing member 118 angularly displaces the distal end of the swing member 118 in the direction indicated by the arrow $C_1$. The wires 120, 122 are now pulled to displace the cam members 113*b*, 113*c* connected to the wires 120, 122 in the directions of the arrows. When the cam member 113*b* is thus displaced, the cam member 113*a* is also displaced as indicated by the arrow by the wire 130. The slanted surfaces of the cam members 113*a*, 113*b*, 113*c* now displace the shafts 98*a*, 98*b*, the shafts 102*a*, 102*b*, and the shafts 106*a*, 106*b* away from each other and hence the rollers 86*a*, 86*b*, the rollers 92*a*, 92*b*, and the rollers 96*a*, 96*b* away from each other, releasing the stimulable phosphor sheet S from the gripped condition.

When released from the roller pairs 86, 92, 96, the stimulable phosphor sheet S is displaced by gravity toward the lower ends of the guide plates 94*a*, 94*b* until the leading end of the stimulable phosphor sheet S hits the bent end of the stopper member 168. The linear actuator of the positioning means 140 is driven to move the displacing member 44 along the guide rod 162 in the direction indicated by the arrow $D_1$. The displacement of the displacing member 144 causes the presser members 146, 148 to bring their bent ends 50, 152 into the respective recesses 154, 156 defined in the guide plate 94*a*. The stimulable phosphor sheet S is therefore laterally pushed in the direction of the arrow $D_1$ by the ends 150, 152 of the presser members 146, 148 until it abuts against the positioning members 141*a*, 141*b*, whereupon the stimulable phosphor sheet S is positioned in the desired position in the transverse direction.

The displacing member 144 is then displaced by the actuator in the direction opposite to the direction of the arrow $D_1$, and the positioned stimulable phosphor sheet S is gripped by the roller pairs 86, 92, 96. That is, the rotative drive source 112 of the displacing means 110 is energized to rotate the cam 114 mounted on the shaft 112*a* to turn the cam lobe 114*a* out of engagement with the swing member 118. The cam members 113*a*, 113*b*, 113*c* are now displaced in the directions opposite to those indicated by the arrows under the resiliency of the springs 136*a*, 136*b*, 136*c* coupled to the respective cam members 113*a*, 113*b*, 113*c*. As a result, the rollers 86*a*, 86*b*, the rollers 92*a*, 92*b*, and the rollers 96*a*, 96*b* of the roller pairs 86, 92, 96 are displaced toward each other under the tension of the coil springs 100, 104, 108, thereby gripping the stimulable phosphor sheet S. The rotative drive source 162 of the stopper means 160 is operated to turn the cam lobe 164*a* out of engagement with the sliding contact member 166, whereupon the stopper member 168 is caused by the tension spring 170 to swing in the direction opposite to the direction indicated by the arrow E. Then, the roller pairs 86, 92, 96 are driven to feed the stimulable phosphor sheet S toward the auxiliary scanning feed means 174.

In the auxiliary scanning feed means 174, the stimulable phosphor sheet S is fed in the direction indicated by the arrow $G_1$ by the auxiliary scanning feed belt 176 until it is placed onto the guide plate 182. At this time, the roller 184 corrects the stimulable phosphor sheet S out of any flexed shape. More specifically, the stimulable phosphor sheet S is more rigid than the film F, and has such a structural nature that the opposite longitudinal ends are flexed in the same direction or upwardly. The roller 184 presses the upwardly flexed ends into the flat shape by engaging those ends.

When the trailing end of the stimulable phosphor sheet S has moved past the scanning area of the image reading and recording mechanism 186, the auxiliary scanning feed belt 176 is moved in the opposite direction to displace the stimulable phosphor sheet S in the auxiliary scanning direction indicated by the arrow $G_2$. At this time, the vacuum suction device is actuated to attract the stimulable phosphor sheet S against the auxiliary scanning feed belt 176 through the first and second suction boxes 178, 180.

While the stimulable phosphor sheet S is being fed as indicated by the arrow $G_2$, the image reading and recording mechanism 186 is energized to enable the laser beam source 188 to emit the laser beam 190. The laser beam 190 is reflected by the mirrors 192, 196 toward the galvanometer mirror 198, which is periodically swung back and forth to deflect and scan the laser beam 190 over the stimulable phosphor sheet S in the main scanning direction. Light emitted from the stimulable phosphor sheet S upon exposure to the laser beam 190 is applied directly or via the reflecting mirror 200 to the light guide 202. The photomultiplier 204 then converts the light from the light guide 202 into an electric signal that is supplied to the image information processing circuit 206. The stimulable phosphor sheet S is thus two-dimensionally scanned by the laser beam 190.

After the image has been read, the stimulable phosphor sheet S is delivered by the roller pairs 96, 92 along the guide plates 94*a*, 94*b* into the position between the movable guides 88*a*, 88*b*. The movable guide plates 88*a*, 88*b* have been angularly displaced in the direction of the arrow $B_1$. Therefore, the stimulable phosphor sheet S is guided by the movable guide plates 88*a*, 88*b* and the roller pair 86 into the position between the fifth feed belt 68 and the seventh feed belt 72 of the fourth feed means 66, by which the stimulable phosphor sheet S is delivered upwardly.

The stimulable phosphor sheet S is further fed upwardly by the third feed means 58 and the second feed means 32, and then directed substantially horizontally into the eraser unit 48. In the eraser unit 48, light emitted from the erasing light source 50 erases any residual image information on the stimulable phosphor sheet S.

The stimulable phosphor sheet S from which residual image information has been eliminated by the eraser unit 48 is fed downwardly again by the second feed means 32 into the third feed means 58. The second switching guide member 76 of the fourth feed means 66 is turned to the broken-line position to direct the stimulable phosphor sheet S into a sheet bin 82 in the stacker 80 through the second switching guide member 76 and the roller pair 78. However, the stimulable phosphor sheet S from the eraser unit 48 may not be stored into the stacker 80, but may be gripped by the fifth feed belt 68 and the sixth feed belt 70 and fed backwards directly into the cassette 20. When a magazine is loaded in the first loading unit 16, the stimulable phosphor sheet S from which the image information has been erased is stored into the tray 56 disposed below the eraser unit 48.

The cassette 20 from which the stimulable phosphor sheet S has been removed is then supplied with a stimulable phosphor sheet S with image information erased therefrom which has been stored in a sheet bin 82 in the stacker 80. More specifically, the stacker 80 is displaced vertically as indicated by the arrow A to position the stimulable phosphor sheet S with image information erased therefrom into alignment with the roller pair 78. Then, the stimulable phosphor sheet S is discharged out of the sheet bin 82 to the right, and gripped by the roller pair 78 and fed thereby toward the fourth feed means 66. The stimulable phosphor sheet S fed to the fourth feed means 66 is delivered upwardly into the third feed means 58. Any remaining image information which may have been left on the stimulable phosphor sheet S is completely removed by the auxiliary eraser unit 64, after which the stimulable phosphor sheet S is fed into the second feed means 32. At this time, the first switching guide member 42 of the second feed means 32 has been angularly displaced to the broken-line position. Therefore, the stimulable phosphor sheet S is guided by the first switching guide member 42 to travel along the first feed belt 36, and then gripped by the roller pair 30 of the first feed means 28. Then, the roller pair 30 is displaced toward the cassette 20, and the rollers thereof are rotated in the directions opposite to those indicated by the arrows to store the stimulable phosphor sheet S into the cassette 20.

When the stimulable phosphor sheet S is fed from the auxiliary scanning feed means 174 into the fourth feed means 66 by the sheet feeding and positioning mechanism 84, the film delivery mechanism disposed near the second loading unit 18 is operated to enable the suction cup 208 to pick up and remove the uppermost one of stacked films F in the magazine 22. The film F removed by the suction cup 208 is gripped by the roller pair 210, which is then rotated to feed the film F into the position between the movable guide plates **88*a*, 88*b* through the guide plates 212*a*, 212*b* and the roller pair 86 of the sheet feeding and positioning mechanism 84. The film F is also positioned in a prescribed position between the guide plates 94*a*, 94*b* in the same manner as the stimulable phosphor sheet S was positioned, as described above. More specifically, the film F is temporarily released from the roller pairs 86, 92, 96, and is transversely pressed in the direction of the arrow $G_1$ by the positioning means 140 until the film F is properly positioned. The film F is then fed into the auxiliary scanning feed means 174 and delivered by the auxiliary scanning feed belt 176 in the direction of the arrow $G_1$ onto the guide plate 182**.

Thereafter, the film F is fed in the opposite direction indicated by the arrow $G_2$ by reversing the direction of movement of the auxiliary scanning feed belt 176. During this time, the film F is attracted to the auxiliary scanning feed belt 176 under a vacuum applied through the suction boxes 178, 180.

When the film F is fed in the direction indicated by the arrow $G_2$, the image reading and recording mechanism 186 is energized again. More specifically, the laser beam 190 is emitted from the laser beam source 188 and reflected by the mirror 192 to reach the light modulator 194. The light modulator 194 is supplied with image signal data from the stimulable phosphor sheet S which have been processed by the image information processing circuit 206 and stored in a memory means (not shown). Therefore, the laser beam 190 which has reached the light modulator 194 has been modulated by the image signal data. The modulated laser beam 190 is reflected by the mirror 196 to reach the galvanometer mirror 198, which is swung back and forth to deflect the laser beam 190 in the main scanning direction while applying the laser beam 190 to the film F.

While the film F is being bed in the auxiliary scanning direction, it is scanned by the laser beam 190 in the main scanning direction. Therefore, the film F is two-dimensionally exposed to the image which has been read from the stimulable phosphor sheet S. While the film F is being exposed to the image, the photomultiplier 204 is deenergized.

After being exposed to the image, the film F is fed from the auxiliary scanning feed means 174 into the position between the movable guide plates **88*a*, 88*b* through the guide plates 94*a*, 94*b* and the roller pairs 96, 92. The movable guide plates 88*a*, 88*b* have been turned by a motor (not shown) in the direction indicated by the arrow $B_2$. With the movable guide plates 88*a*, 88*b* thus angularly displaced, the film F is delivered by the rollers pairs 96, 92 into the film feed means 214 in which the film F is gripped by the roller pair 216. The film F gripped by the roller pair 216 is then fed upwardly by rotation of the roller pair 216, and delivered continuously upwardly by the roller pairs 218, 220. Subsequently, the film F is guided along a curved path by the guide plates 228*a*, 228*b* and fed by the roller pair 222 through the opening 230 into the receiver magazine 232. After a predetermined number of films F have been stored in the receiver magazine 232, the receiver magazine 232 is removed from the housing 12** in a light-shielded condition, and then the films F are loaded into an image developing device (not shown) to develop the images on the films F.

According to the illustrated embodiment, the stimulable phosphor sheet S or the film F is positioned in the predetermined position when they are to be delivered into the auxiliary scanning feed means 174 by the sheet feeding and positioning mechanism 74. Specifically, in order to position the stimulable phosphor sheet S or the film F which have been delivered into the sheet feeding and positioning mechanism 84, the drive source 162 of the stopper means 160 is energized to cause the cam lobe 164a to engage the sliding contact member 166. The stopper 168 is now displaced in the direction of the arrow E to prevent the stimulable phosphor sheet S or the film F from being further displaced toward the auxiliary scanning feed mechanism 174.

Then, the rollers 86a, 86b, the rollers 92a, 92b, and the rollers 96a, 96b of the roller pairs 86, 92. 96 for gripping and feeding the stimulable phosphor sheet F or the film F are displaced away from each other. The linear actuator of the positioning means 140 is driven to displace the displacing member 144 in the direction indicated by the arrow $D_1$. As a result, the stimulable phosphor sheet S or the film F are pressed against the positioning members 141a, 141b by the bent ends 150, 152 of the presser members 146, 148 coupled to the displacing member 144, whereupon the stimulable phosphor sheet F or the film F is positioned in place. After the stimulable phosphor sheet S or the film F has been positioned, it is gripped again by the roller pairs 86, 92, 96 and fed into the auxiliary scanning feed means 174. Therefore, since the stimulable phosphor sheet S or the film F which is fed into the auxiliary scanning feed means 174 is delivered into a predetermined position at all times, an image can be read from the stimulable phosphor sheet S or reproduced on the film F highly accurately by the image reading and recording mechanism 186.

With the present invention, as described above, when a sheet such as a stimulable phosphor sheet or a photographic photosensitive sheet is to be fed by a plurality of roller pairs for an image reading or reproducing process, the sheet is first released from the roller pairs and thereafter positioned into a desired position by a positioning means. The sheet which has been positioned by the positioning means is then gripped again by the roller pairs and fed for the image recording or reproducing process. Consequently, when an image is to be read from the sheet or reproduced on the sheet, the sheet is delivered accurately into a desired reading or reproducing position. Accordingly, an image can be read from the sheet or reproduced on the sheet with high accuracy.

Although a certain preferred embodiment has been shown and described, it should be understood that many changes and modifications may be made therein without departing from the scope of the appended claims.

What is claimed is:

1. A method of feeding and positioning a sheet for reading an image from the sheet or reproducing an image from the sheet, said method comprising the steps of:

gripping the sheet with at least one pair of rollers to feed the sheet;

displacing said rollers away from each other to release the sheet between the rollers;

displacing the sheet in a predetermined direction to position the sheet in a prescribed position; and gripping the positioned sheet again with said rollers to feed the sheet toward an image reading or reproducing mechanism, wherein said step of displacing the sheet comprises the step of displacing the sheet in a lateral direction substantially perpendicular to the direction in which the sheet is fed by said rollers, by engaging a lateral edge of the sheet and pushing the sheet in said lateral direction.

2. A mechanism for feeding and positioning a sheet, comprising:

at least one pair of rollers for gripping the sheet to feed the sheet;

displacing means for displacing said rollers away from each other to release the sheet between the rollers; and positioning means for displacing the sheet in a predetermined direction to position the sheet in a prescribed position, wherein said positioning means comprises a positioning member disposed on one lateral side of a path along which said sheet is fed by said rollers, a displacing member movable back and forth in directions substantially perpendicular to said path and having a presser member which includes a bent end extending above said path for pressing an edge of the sheet, and an actuator for moving said displacing member toward said one lateral side to cause said presser member to push the sheet against said positioning member, thereby positioning the sheet.

3. A mechanism according to claim 2 further including stopper means for holding the sheet in place when said rollers are displaced away from each other by said displacing means.

4. A mechanism according to claim 2 or 3, wherein said rollers are normally urged to be held against each other by a resilient member, said displacing means comprising a cam member disposed between said rollers and operatively engaging said rollers, and an actuator for moving said cam member selectively in a first direction to move said rollers away from each other and in a second direction opposite to said first direction for moving said rollers toward each other.

5. A mechanism according to claim 4, wherein said actuator comprises a rotative drive source, a cam rotatable by said rotative drive source, a swing member engaging said cam and angularly movable thereby, a filamentary member having one end coupled to said swing member and the other end connected to one end of said cam member, and a resilient member engaging the opposite end of said cam member for normally urging the cam member in said second direction.

6. A mechanism according to claim 5, comprising at least two pairs of rollers for gripping the sheet to feed the sheet, said displacing means comprising at least two cam members disposed respectively between the rollers in the respective pairs, said filamentary member being connected at the other end thereof to said one end of each of the cam members, whereby said cam members are movable in unison by said filamentary member when said rotative drive source is operated.

7. A mechanism according to claim 3, wherein said stopper means comprises an actuator and a stopper member swingable by said actuator into a path along which said sheet is fed by said rollers, for holding one end of the sheet.

8. A mechanism according to claim 2, further wherein said path is defined by a pair of guide plates, with at least one of said guide plates having a recess for receiving said bent end of said presser member for pressing the edge of the sheet.

9. A mechanism according to claim 2, further wherein said displacing member is movable back and forth along a guide rod.

* * * * *